US006876829B2

(12) United States Patent
Masham

(10) Patent No.: US 6,876,829 B2
(45) Date of Patent: Apr. 5, 2005

(54) XEROGRAPHIC PRINTING SYSTEM WITH MAGNETIC SEAL BETWEEN DEVELOPMENT AND TRANSFER

(75) Inventor: Roger D. Masham, Ashwell (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/426,077

(22) Filed: Apr. 29, 2003

(65) Prior Publication Data

US 2004/0114957 A1 Jun. 17, 2004

Related U.S. Application Data

(60) Provisional application No. 60/433,890, filed on Dec. 16, 2002.

(51) Int. Cl.[7] ..... G03G 15/08
(52) U.S. Cl. ..... 399/104
(58) Field of Search ..... 399/104, 264, 399/296, 356

(56) References Cited

U.S. PATENT DOCUMENTS 4,244,322 A * 1/1981 Nomura et al. ..... 399/275
4,676,191 A * 6/1987 Kojima et al. ..... 399/104
4,697,914 A * 10/1987 Hauser ..... 399/104
5,081,503 A * 1/1992 Parker et al. ..... 399/264
5,138,382 A 8/1992 Van Duser et al.
5,283,617 A 2/1994 Benedict et al.
5,376,997 A 12/1994 Yamato et al.
6,047,154 A * 4/2000 Kawaguchi ..... 399/264
6,336,013 B1 * 1/2002 Suda et al. ..... 399/103

FOREIGN PATENT DOCUMENTS

JP 56158357 A * 12/1981 ..... G03G/15/09
JP 59045469 A * 3/1984 ..... G03G/15/08
JP 61032874 A * 2/1986 ..... G03G/15/09
JP 63243976 A * 10/1988 ..... G03G/15/08
JP 05011618 A * 1/1993 ..... G03G/15/09
JP 08095388 A * 4/1996 ..... G03G/15/09
JP 10055114 A * 2/1998 ..... G03G/15/09

* cited by examiner

*Primary Examiner*—Robert Beatty
(74) *Attorney, Agent, or Firm*—R. Hutter

(57) ABSTRACT

In a xerographic development apparatus using a magnetic brush formed from magnetic carrier particles, a magnetic strip disposed downstream of the development zone along the direction of motion of the photoreceptor retains a separate, small brush of carrier particles near the photoreceptor. The brush acts as a barrier separating a flow of "dirty" air (laden with airborne toner particles) upstream of the strip, and a flow of clean air downstream of the strip.

6 Claims, 4 Drawing Sheets

XEROGRAPHIC PRINTING SYSTEM WITH MAGNETIC SEAL BETWEEN DEVELOPMENT AND TRANSFER

CLAIM OF PRIORITY FROM PROVISIONAL APPLICATION

Priority is hereby claimed from U.S. Provisional Application 60/433,890, filed Dec. 16, 2002.

TECHNICAL FIELD

The present invention relates to electrostatographic or xerographic printing systems.

BACKGROUND

In the well-known process of electrostatographic printing, the most common type of which is known as "xerography," a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finally divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate, such as paper, and the image affixed thereto to form a permanent record of the image to be reproduced.

The step in the electrostatographic process in which the toner is applied to the latent image is known as "development." In any development system, a quantity of toner is brought generally into contact with the latent image, so that the toner particles will adhere or not adhere to various areas on the surface in conformity with the latent image. Many techniques for carrying out this development are known in the art. A number of such techniques require that the toner particles be evenly mixed with a quantity of "carrier." Generally speaking, toner plus carrier equals "developer." Typically, toner particles are extremely fine, and responsive to electric fields; carrier particles are relatively large and respond to magnetic fields.

In a "magnetic brush" development system, the developer is exposed to magnetic fields, causing the carrier particles to form brush-like strands, much in the manner of iron filings when exposed to a magnetic field. The toner particles, in turn, are triboelectrically adhered to the carrier particles in the strands. What is thus formed is a brush of magnetic particles with toner particles adhering to the strands of the brush. The base of the brush is formed on a "magnetic roll," which is typically in the form of a sleeve rotating around a fixed arrangement of magnets: the toner and carrier form the brush on the outside of the sleeve, influenced by the fields of the magnets inside the sleeve. This magnetic brush is brought in contact with the electrostatic latent image, and under certain conditions the toner particles separate from the carrier particles and adhere as necessary to the photoreceptor.

DESCRIPTION OF THE PRIOR ART

U.S. Pat. No. 5,138,382 shows a xerographic development unit wherein a rotating pickoff roller, including a set of magnets, is disposed downstream of the magnetic developer roll along the process direction of the photoreceptor. The pickoff roller forms a curtain of carrier beads within the development unit, which prevents the escape of airborne toner particles from the development unit.

U.S. Pat. No. 5,283,617 shows a xerographic development unit with a rotating pickoff roller, or "bead removal device," including a set of magnets, and an external vacuum source which in turn draws carrier off the pickoff roller.

U.S. Pat. No. 5,376,997 shows a xerographic development unit wherein a pickoff roller, including a set of magnets within a rotating sleeve, is disposed downstream of the magnetic developer roll along the process direction of the photoreceptor.

The Fuji Xerox® 3500 product, launched in about 1979, employed a stationary magnetic strip adjacent the photoreceptor downstream (along the direction of photoreceptor motion) of the development zone; the Xerox® 5616 product employed a stationary magnetic strip adjacent the photoreceptor upstream of the development zone. However, in each of those products, the photoreceptor and sleeve of the developer roll moved in the same direction through the development zone, and therefore a set of airflows such as described below would not be set up by the motion of the photoreceptor and sleeve. Further, the Xerox® 5052 product employed a stationary magnetic strip adjacent the photoreceptor upstream of the development zone, but in that product the development zone was associated with two developer rolls, one turning with the motion of the photoreceptor and one against, in effect both developer rolls rotating "outward" from the development zone; once again, the airflows set up by these two developer rolls are not similar to the arrangement described below.

SUMMARY OF THE INVENTION

According to one aspect of the present invention, there is provided an electrostatographic printing apparatus, comprising a charge receptor defining a charge-retentive surface, the charge receptor being movable in a process direction; a development unit including a rotatable sleeve for conveying developer to a development zone adjacent a portion of the charge-retentive surface, the rotatable sleeve moving in a direction opposite the process direction in the development zone; and a nonmoving magnetic strip disposed downstream of the development zone. The magnetic strip is positioned to maintain a brush of carrier particles substantially directly thereon.

DETAILED DESCRIPTION

Figure 1:
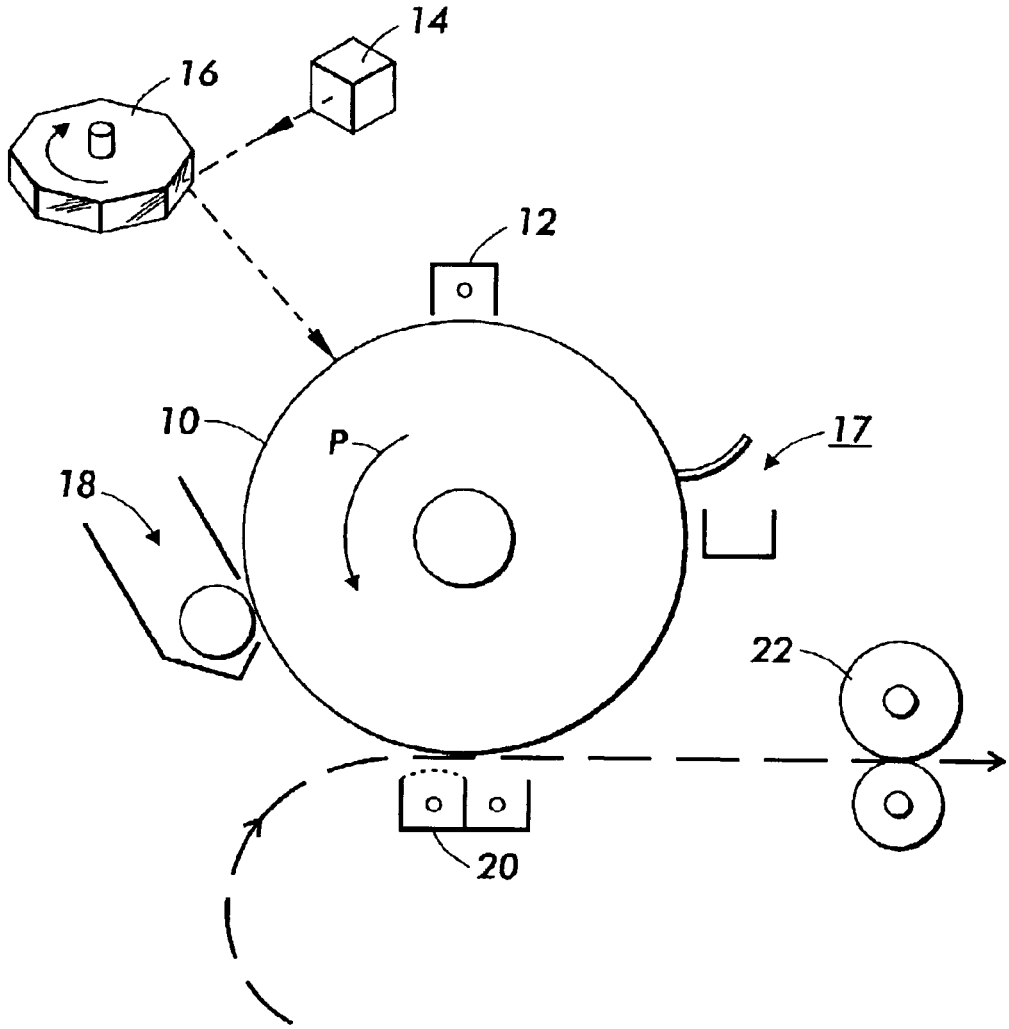
FIG. 1 PRIOR ART
FIG. 1 shows the basic elements of a xerographic printer.

FIG. 1 shows the basic elements by which a electrostatographic or xerographic printer, such as a copier or a "laser printer," creates a dry-toner image on plain paper. There is provided in the printer a charge receptor such as photoreceptor 10, which may be in the form of a belt or drum, and which defines a charge-retentive surface for forming electrostatic images thereon. The photoreceptor 10 is caused to rotate through process direction P.

The first step in the process is the general charging of the relevant photoreceptor surface. This initial charging is performed by a charge source such as a "scorotron," indicated as 12. The scorotron 12 typically includes an ion-generating structure, such as a hot wire, to impart an electrostatic charge on the surface of the photoreceptor 10 moving past it. The charged portions of the photoreceptor 10 are then selectively discharged in a configuration corresponding to the desired image to be printed, by a raster output scanner or ROS, which generally comprises a laser source 14 and a rotatable mirror 16 which act together, in a manner known in the art, to discharge certain areas of the surface of photoreceptor 10 according to a desired image to be printed. Although the Figure shows a laser 14 to selectively discharge the charge-retentive surface, other apparatus that can be used for this purpose include an LED bar, or, in a copier, a light-lens system. The laser source 14 is modulated (turned on and off) in accordance with digital image data fed into it, and the rotating mirror 16 causes the modulated beam from laser source 14 to move in a fast-scan direction perpendicular to the process direction P of the photoreceptor 10.

After certain areas of the photoreceptor 10 are discharged by the laser source 14, the remaining charged areas are developed by a developer unit such as 18, causing a supply of dry toner to contact or otherwise approach the surface of photoreceptor 10. The developed image is then advanced, by the motion of photoreceptor 10, to a transfer station 20, which causes the toner adhering to the photoreceptor 10 to be electrically transferred to a print sheet, which is typically a sheet of plain paper, to form the image thereon. The sheet of plain paper, with the toner image thereon, is then passed through a fuser 22, which causes the toner to melt, or fuse, into the sheet of paper to create the permanent image.

Figure 2:
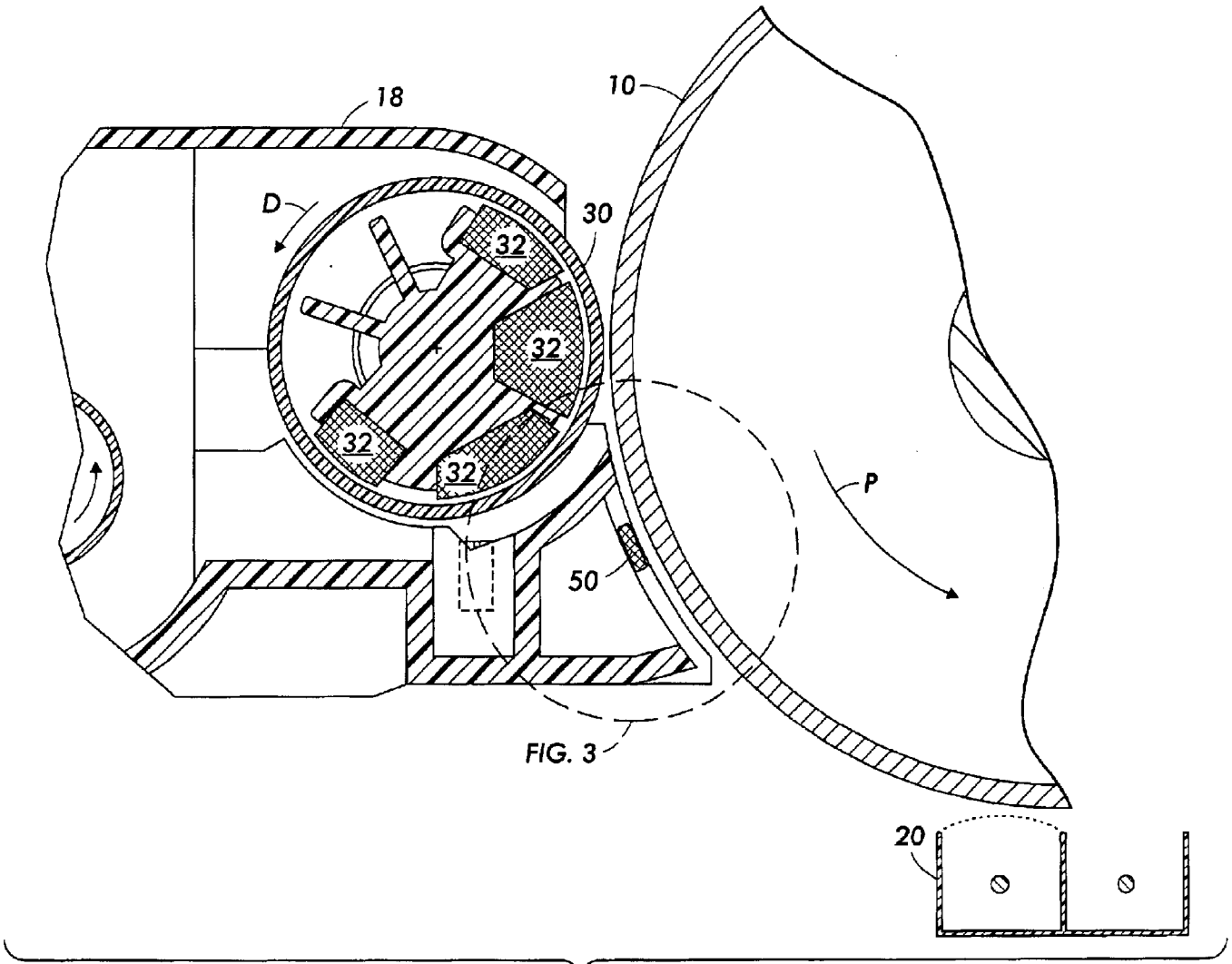
FIG. 2 is a detailed elevational view of the portion of the photoreceptor between the developer unit and the transfer station of the xerographic printer of FIG. 1.

FIG. 2 is a detailed elevational view of the portion of the photoreceptor 10 between the developer unit 18 and the transfer station 20. In this embodiment, the developer unit 18 includes a magnetic roll formed by a sleeve 30 which rotates, as shown by direction D, around an assembly including any number of fixed permanent magnets 32. The fields of the various magnets 32 through the sleeve 30 act to convey developer, in the form of a magnetic brush (not shown), toward the photoreceptor 18. The zone between the sleeve 30 and photoreceptor 10 where the magnetic brush provides toner particles to develop a latent image on photoreceptor 10 is known as a "development zone."

The illustrated embodiment includes the photoreceptor 10 and the sleeve 30 of the magnetic roll moving in opposite directions within the development zone, as shown by the arrows in FIG. 2. In practice, if the height of the magnetic brush created on the magnetic roll is in a suitable range relative to the total spacing between the magnetic roll and the photoreceptor in the development zone, in an arrangement where the magnetic roll and photoreceptor move in opposite directions, an air flow is created between the photoreceptor 10 and the sleeve 30 in a direction against the process direction P of the photoreceptor 18. This air flow, or "boundary air stream," along the surface of photoreceptor 10 is useful for preventing airborne or otherwise stray toner particles from migrating down the process direction and, for instance, contaminating the transfer station 20, which could result in unintended marks on the transferred image or on the back of the print sheet.

Under certain circumstances, this boundary air stream is disrupted. If, for instance, there is a temporary condition of a high T/C (toner to carrier) ratio or low triboelectric levels in the development unit 18, the magnetic brush in the development zone itself disrupts the boundary air stream around the photoreceptor 10. If the boundary air stream is thus disrupted, airborne or stray toner particles can move to contaminate the transfer station 20.

To avoid such disruption of the boundary air stream, a simple N/S permanent magnetic strip 50, which extends across photoreceptor 10 in a direction perpendicular to process direction P, is provided. Strip 50, by virtue of its magnetic fields, maintains a bipolar brush between the development zone and the transfer station 20. The brush of carrier created by strip 50 acts as an air-permeable seal allowing air flow towards the development zone while preventing contaminated air from escaping downward to the transfer station 20. As a result of reduced pressure near the development roll which generates an air flow counter to the process direction of the photoreceptor 10, the brush formed on strip 50 itself remains clean and does not fail due to a build up of toner within it.

Figure 3:
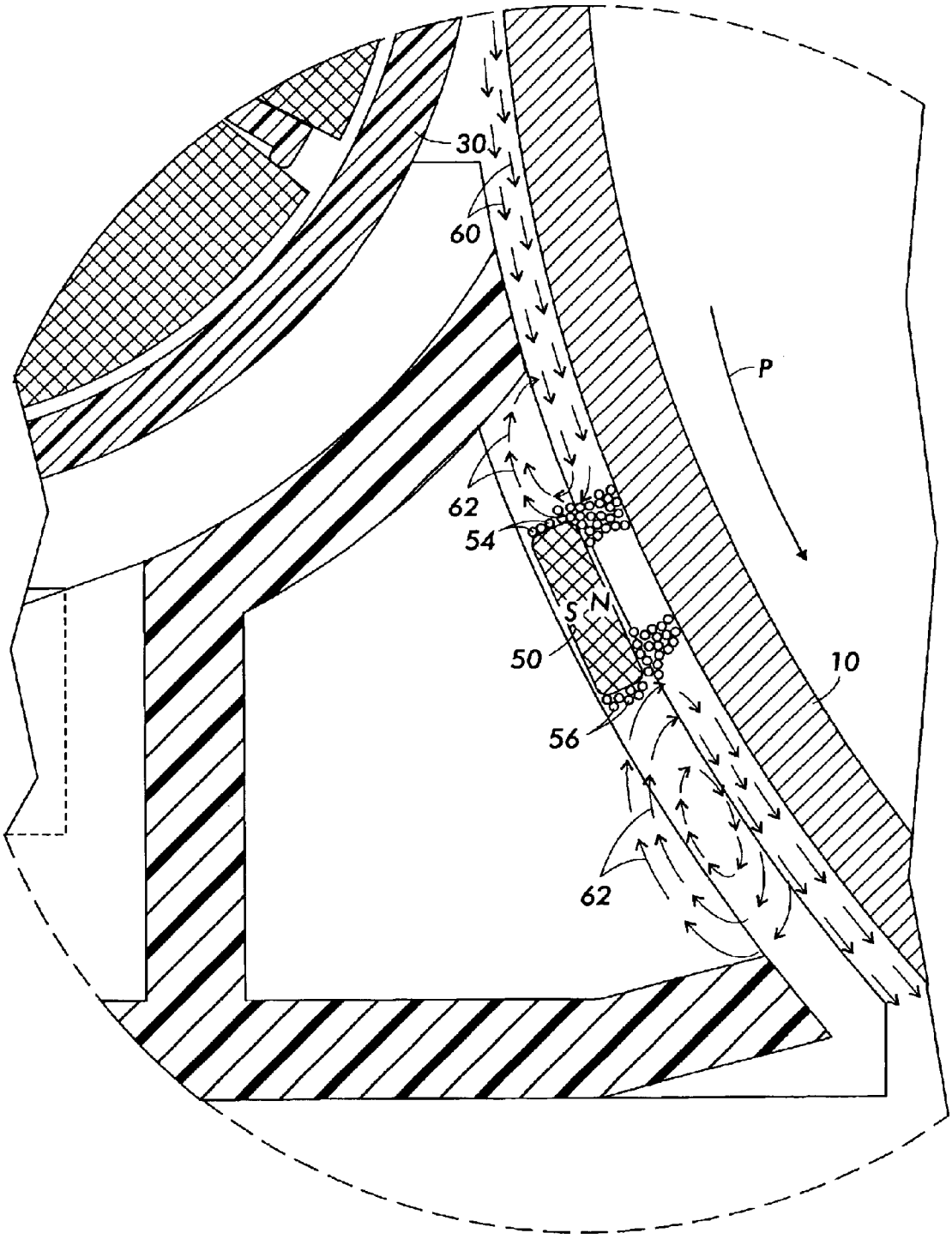
FIG. 3 is a further detailed elevational view of a zone between the development zone and the transfer station in the embodiment of FIG. 2.

FIG. 3 is a further detailed elevational view of a zone between the development zone and the transfer station in the embodiment of FIG. 2, showing a typical pattern of air flows, indicated by arrows, induced by the behavior of the magnetic strip 50. The magnetic strip 50 is disposed fairly close to the surface of photoreceptor 10; one or more small brushes of carrier particles, such as indicated as 54 and 56 is thus maintained in contact with the surface of photoreceptor 10. Each small brush acts to restrict airflow therethrough, in effect acting as a barrier substantially, but not necessarily completely, separating a circulating flow 60 of "dirty" (laden with airborne toner particles) air upstream of the strip 50 in the process direction P, and a circulating flow 62 of "clean" air downstream of the strip 50 in the process direction P. As can be seen by the arrows in flow 62, the dominant behavior of the air is to enter the zone below strip 50 against process direction P of photoreceptor 10; however, a boundary layer of air immediately adjacent the surface of photoreceptor 10 is often flowing with the process direction P.

One or more poles associated with a magnetic strip such as 50 can be placed in close proximity to the photoreceptor 10, although in one practical embodiment such as illustrated in FIG. 3, only the N pole faces the photoreceptor 10. As can be seen in the Figure, this single pole facing the photoreceptor results in two brushes of carrier particles, indicated as 54 and 56; in other implementations, other configurations of magnetic poles will result in one or more brushes of various characteristics. In that implementation, what small airflow as can pass through brushes 54 and 56 is largely in the upstream direction, against the direction of a boundary layer of air around the moving photoreceptor 10.

Figure 4:
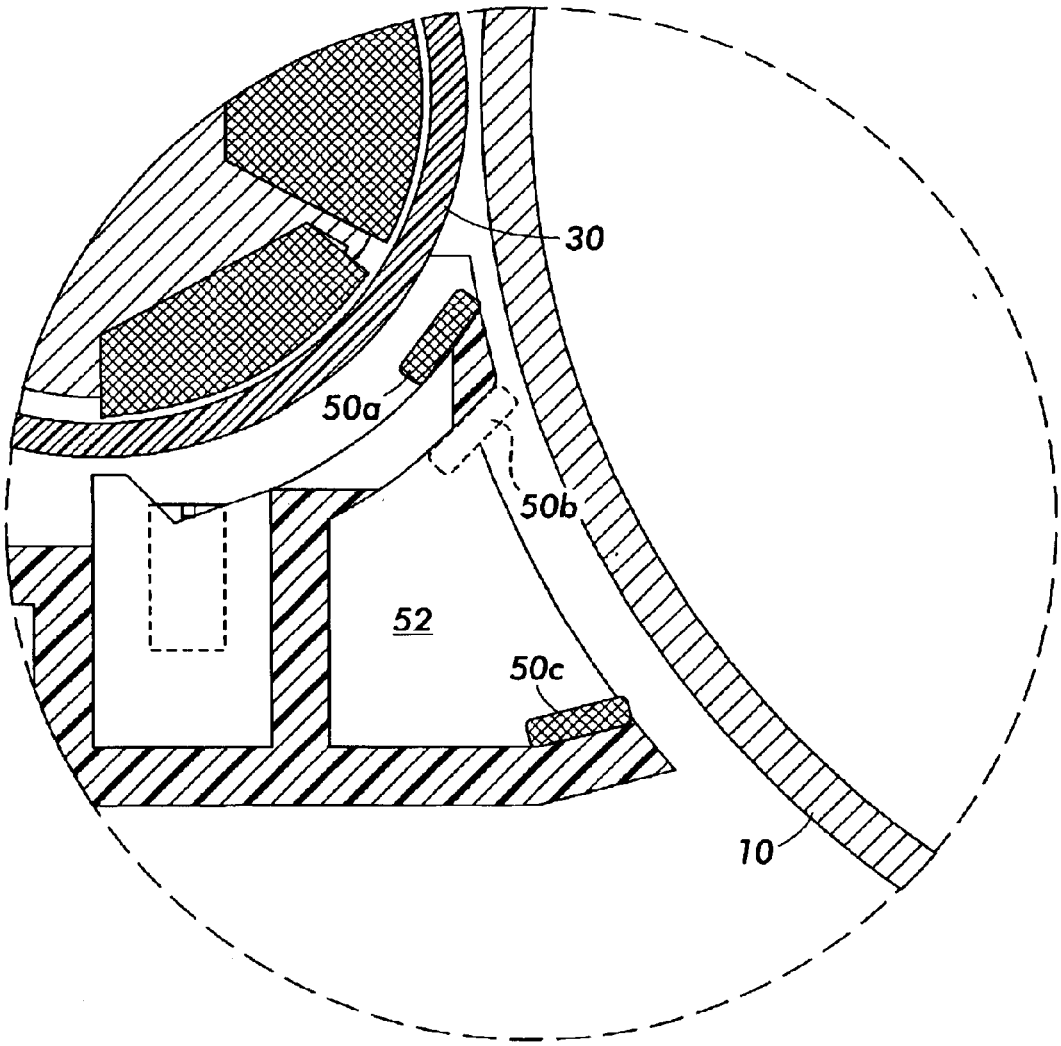
FIG. 4 is an elevational view of a structure adjacent the zone between the development zone and the transfer station, showing alternate locations of a magnetic strip.

FIG. 4 is an elevational view of a structure adjacent the zone between the development zone and the transfer station in the embodiment of FIG. 2, showing alternate locations of a strip such as 50, in FIG. 4 shown as 50*a*, 50*b*, and 50*c*. (In any one practical embodiment, only one of the strips would be installed.) In particular, strip 50*a* is shown as being essentially at the edge of the development zone; 50*b* is shown as being spaced mainly inside a cavity 52 adjacent photoreceptor 10; and 50*c* is disposed close to the transfer station 20. In various embodiments, it is possible to include one or more of the alternately-positioned strips 50*a*, 50*b*, and 50*c*, in addition to or instead of the strip 50 shown in FIG. 2. Also, depending on a specific embodiment, each of the strips may define one or more poles adjacent the photoreceptor 10, to control the position and behavior of one or more brushes of carrier particles.

What is claimed is:

1. An electrostatographic printing apparatus, comprising:

a charge receptor defining a charge-retentive surface, the charge receptor being movable in a process direction;

a development unit including a rotatable sleeve for conveying developer to a development zone adjacent a portion of the charge-retentive surface, the developer including toner and carrier particles;

the rotatable sleeve moving in a direction opposite the process direction in the development zone; and a nonmoving magnetic strip disposed downstream of the development zone, the magnetic strip being positioned to maintain a brush of carrier particles substantially directly thereon with the brush in contact with the charge retentive surface, the brush of carrier particles substantially restricting an air flow passing through the development zone along the charge receptor.

2. The apparatus of claim 1, the magnetic strip extending across the charge-retentive surface in a direction perpendicular to the process direction.

3. The apparatus of claim 1, the brush of carrier particles substantially forming a barrier to substantially separate a first air flow upstream of the magnetic strip and a second air flow downstream of the magnetic strip.

4. The apparatus of claim 1, the magnetic strip defining at least two poles adjacent the charge receptor.

5. An electrostatographic printing apparatus, comprising:

a charge receptor defining a charge-retentive surface, the charge receptor being movable in a process direction;

a development unit Including a rotatable sleeve for conveying developer to a development zone adjacent a portion of the charge-retentive surface, the developer including toner and carrier particles;

the rotatable sleeve moving in a direction opposite the process direction in the development zone; and a nonmoving first magnetic strip disposed downstream of the development zone, the first magnetic strip being positioned to maintain a brush of carrier particles substantially directly thereon, the magnetic strip defining at least one pole adjacent the charge receptor, the one pole resulting in two brushes of carrier particles between the magnetic strip and the charge receptor.

6. An electrostatographic printing apparatus, comprising:

a charge receptor defining a charge-retentive surface, the charge receptor being movable in a process direction;

a development unit including a rotatable sleeve for conveying developer to a development zone adjacent a portion of the charge-retentive surface, the developer including toner and carrier particles;

the rotatable sleeve moving in a direction opposite the process direction in the development zone;

a nonmoving first magnetic strip disposed downstream of the development zone, the first magnetic strip being positioned to maintain a brush of carrier particles substantially directly thereon; and a second magnetic strip disposed downstream of the development zone.

* * * * *